US006589080B2

(12) United States Patent
Tanaka

(10) Patent No.: US 6,589,080 B2
(45) Date of Patent: Jul. 8, 2003

(54) TERMINAL FITTING AND A CONNECTOR

(75) Inventor: Akane Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/027,530

(22) Filed: Dec. 26, 2001

(65) Prior Publication Data

US 2002/0081828 A1 Jun. 27, 2002

(30) Foreign Application Priority Data

Dec. 25, 2000 (JP) ..... 2000-393544
Dec. 25, 2000 (JP) ..... 2000-393560

(51) Int. Cl.[7] ..... H01R 13/40
(52) U.S. Cl. ..... 439/595; 439/744
(58) Field of Search ..... 439/595, 752.5, 439/733.1, 744, 746, 747, 748, 749

(56) References Cited

U.S. PATENT DOCUMENTS 4,571,017 A * 2/1986 Fujita ..... 439/595
6,146,215 A * 11/2000 Matsushita et al. ..... 439/752.5

FOREIGN PATENT DOCUMENTS

JP 6-325814 11/1994

* cited by examiner

*Primary Examiner*—Renee Luebke
*Assistant Examiner*—Ross Gushi
(74) *Attorney, Agent, or Firm*—Anthony J. Casella; Gerald E. Hespos

(57) ABSTRACT

A connector has a housing (20) with a plurality of cavities (21) for accommodating terminal fittings (10). A resiliently deflectable lock (37) is provided at the bottom surface of each cavity (21). Terminal fittings (10) are inserted into the cavities (21). Front and rear stabilizers (13A, 13B) project down from each terminal fitting (10) and are separate by an engaging recess (17) into which a portion (38) of the respective lock (37) is inserted for locking the terminal fitting (10) in the cavity (21).

15 Claims, 12 Drawing Sheets

TERMINAL FITTING AND A CONNECTOR

BACKGROUND OF THE INVENTION

1. Field of the Invention

The invention relates to a terminal fitting and a connector.

2. Description of the Related Art

A known connector is disclosed in Japanese Unexamined Patent Publication No. 6-325814 and also is shown in FIG. 16 herein. With reference to FIG. 16, the connector has a housing 1 and terminal fittings 2. Cavities 3 are arranged at two stages in the housing 1 and the terminal fittings 2 are inserted from behind into the cavities 3. The housing 1 is formed with deformation permitting spaces 4 adjacent the cavities 3. Resiliently deformable locks 5 project from upper surfaces of the cavities 3 at locations adjacent the deformation permitting spaces 4. More particularly, the locks 5 for the cavities in the lower stage are formed integrally with partition walls between the upper and lower stages of cavities 3, while the locks 5 for the cavities 3 in the upper stage project integrally from the upper wall 7 of the housing 1. The locks 5 are configured to deflect into the deformation permitting spaces 4 as the terminal fittings 2 are inserted into the cavities 3. The locks 5 are restored resiliently when the terminal fittings 2 are inserted to a proper depth to engage the terminal fittings 2 and to prevent the terminal fittings 2 from coming out of the cavities 3.

The locks 5, the deformation permitting spaces 4 and the partition walls 6 between the upper and lower cavities 3 are placed one over another along a straight vertical line in the connector of FIG. 16. Thus, the connector has a large height. The height is particularly great, if an attempt is made to increase the number of contacts of the connector.

The connector shown in FIGS. 17 and 18 has been proposed in an effort to achieve an acceptable height. This connector has cavities 50. Locks 51 are provided at the bottom of the cavities 50 and are resiliently deformable in the widthwise direction, which is normal to the plane of FIGS. 17 and 18. The cavities 50, the locks 51 and deformation permitting spaces for the locks 51 are not arranged along a straight vertical line. Thus, the connector can be short. The connector is used with terminal fittings 53, each of which has a front end and a substantially planar stabilizer 54 that projects down from the front end. The connector also is formed with guide grooves 55 in the bottom surfaces of the cavities 50. The stabilizers 54 fit into the guide grooves 55 during insertion of the terminal fitting 53 into the cavities 50 to guide the inserting movement of the terminal fittings 53. The locks 51 engage the rear edges of the stabilizers 54 to lock the terminal fittings 53 in the cavities 50. Thus, the stabilizers 54 both guide the insertion and engage with the locks 51. Hence, the construction of the terminal fitting 53 is simple.

An object of the invention is to provide a terminal fitting and a connector that can improve the guiding function of a stabilizer while avoiding enlargement of the connector.

SUMMARY OF THE INVENTION

The invention is directed to a terminal fitting that is insertable in a forward longitudinal inserting direction into a cavity of a connector housing. The connector housing includes a resiliently deflectable lock that projects into the cavity for locking the terminal fitting in the cavity. The housing also is formed with a guide groove that extends longitudinally along an inner wall of the cavity. The terminal fitting comprises a stabilizer that projects from the remainder of the terminal fitting in a projecting direction that is aligned at an angle to the inserting direction of the terminal fitting. The stabilizer is disposed and dimensioned for insertion in the guide groove for guiding the insertion of the terminal fitting into the cavity. An engaging recess is formed at an intermediate longitudinal position on the stabilizer and is disposed and dimensioned for engagement by the lock. The engagement of the lock at an intermediate position on the stabilizer enables the stabilizer to be elongated without enlarging the connector. The longer stabilizer also improves the guiding of the terminal fitting into the cavity.

The stabilizer preferably has a tapered front end. Accordingly, the stabilizer is not likely to damage a sealing or rubber plug when the terminal fitting is inserted through the plug and into the cavity.

The stabilizer also may be slanted along its width direction to define slanted guide portions.

The stabilizer preferably comprises spaced-apart front and rear stabilizer portions that are separated by the engaging recess. The engaging recess need not extend entirely through the stabilizer.

A sealing plug entrance restricting portion may be provided to restrict an entrance of part of a sealing plug into the engaging recess when the terminal fitting is inserted through a through hole in the sealing plug. Hence, damage to the sealing plug can be avoided and a watertight fit can be improved.

The front and rear portions of the stabilizer and the sealing plug entrance restricting portion preferably are integrally or unitarily continuous with each other. Accordingly, the stabilizer can be of relatively simple construction.

Most preferably, the stabilizer and the guide groove are configured to provide an orientation means for hindering an upside down insertion of the terminal fitting into the cavity.

The invention also is directed to a connector with a housing. The housing is formed with a cavity into which the above-described terminal fitting can be inserted. A resiliently deflectable lock is provided in the cavity for engaging the terminal fitting and locking the terminal fitting in the cavity.

The connector may comprise at least one sealing plug disposed in a sealing plug mount recess of the housing to waterproof the connector. The stabilizer may comprise the above-described sealing plug entrance restricting portion for restricting entrance of the sealing plug into the engaging recess when the terminal fitting is inserted through a through hole in the sealing plug.

A partition wall preferably is provided between adjacent cavities for partitioning the cavities from each other. The lock preferably is formed in the partition wall between adjacent cavities such that the lock is deflected at an angle to an imaginary line passing through the center of the adjacent cavities.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector according to the invention is illustrated in FIGS. 1 to 7. The connector has female terminal fittings 10 and a connector housing 20 for accommodating the terminal fittings 10. In the following description, an inserting direction ID of the terminal fittings 10 into the housing 20 is referred to as a forward direction and the vertical direction is based on the orientation shown in FIGS. 1, 3, 4, 6 and 7.

Figure 1:
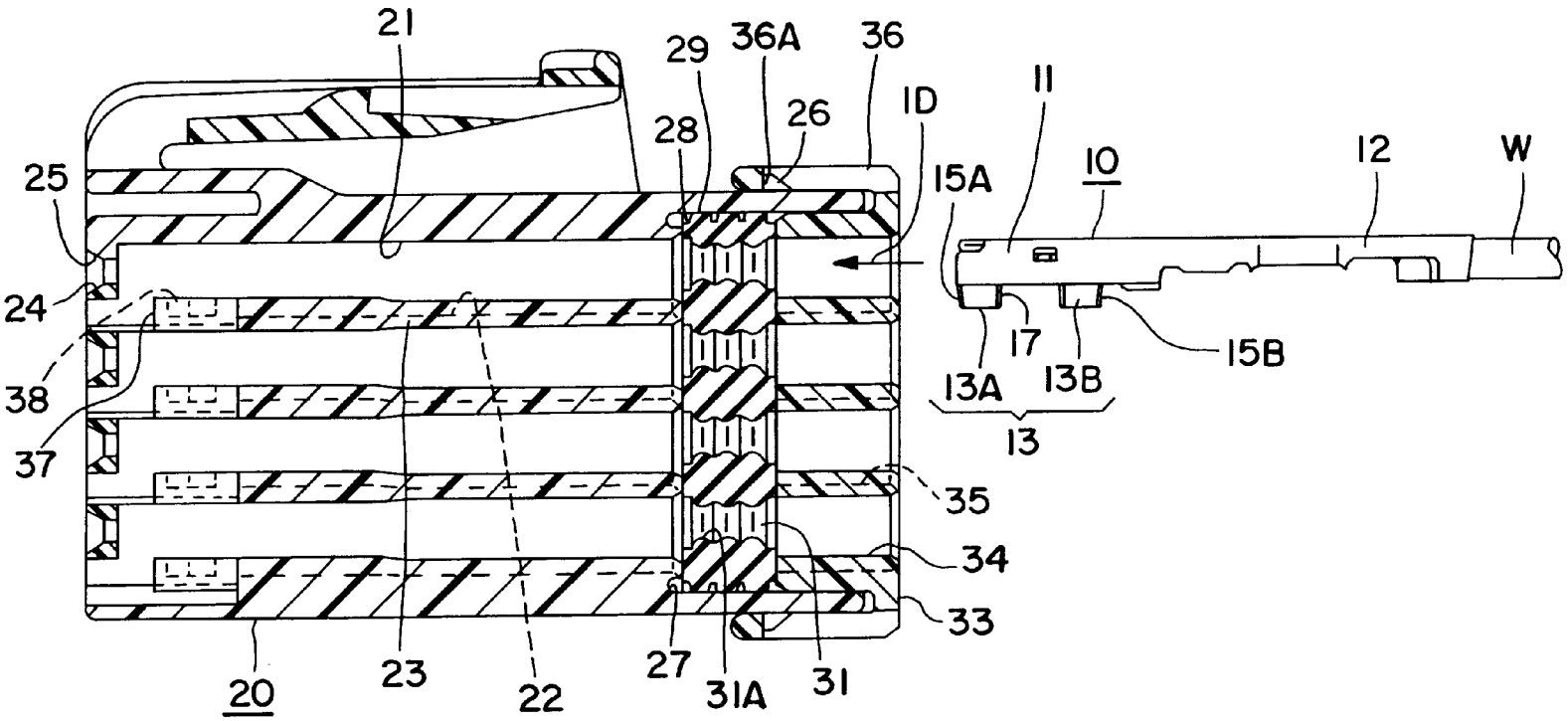
FIG. 1 is an exploded side view in section of a female connector according to one embodiment of the present invention.
Figure 3:
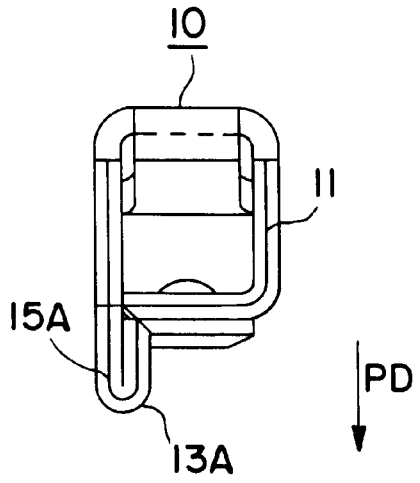
FIG. 3 is a front view of a female terminal fitting.

Each terminal fitting 10 is formed by press-working (e.g. stamping, cutting, bending, folding, embossing, milling, etc.) a metallic plate. As shown in FIG. 1, each terminal fitting 10 has a substantially box-shaped main body 11 and a barrel 12 crimped, folded or bent into connection with an end of a wire W. The main body 11 has an open front end into which a mating male terminal fitting (not shown) can be inserted for electrical connection. Front and rear stabilizers 13A and 13B project down from a side edge of the bottom surface of the main body 11, as shown in FIGS. 1 and 3, and are spaced apart along forward and backward or longitudinal directions. The stabilizers 13A, 13B are formed by folding the metallic plate back, and thus define a substantially planar structure with a thickness twice the thickness of the metallic plate. The front stabilizer 13A has a rearwardly tapered front end 15A with a base adjacent the front end of the main body 11. However, the front end 15A is slanted rearwardly at locations below the main body 11. The rear stabilizer 13B is near the center of the main body 11 with respect to forward and backward or longitudinal directions, and has a rear end 15B that is slanted forwardly at locations below the main body 11. An engaging recess 17 is formed between the front and rear stabilizers 13A and 13B.

Figure 4:
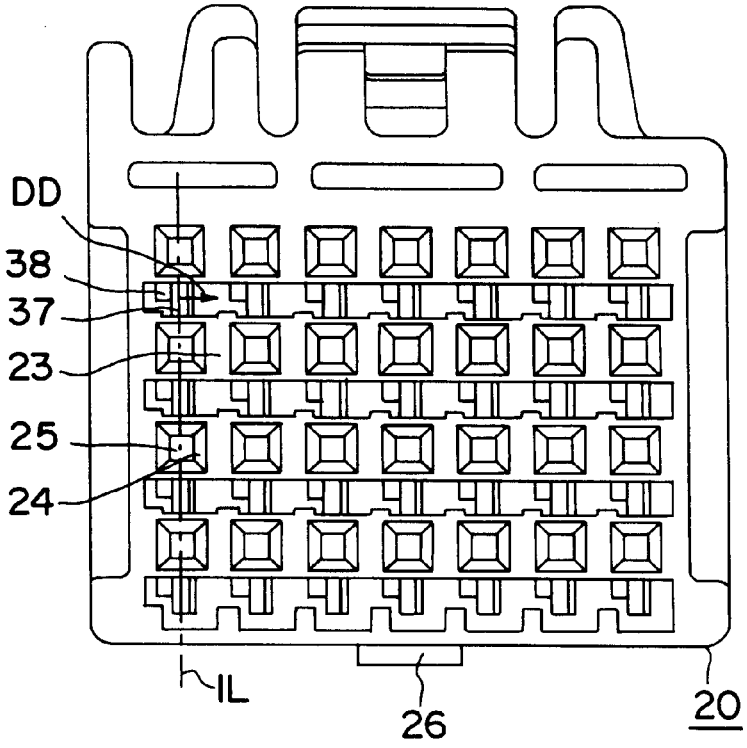
FIG. 4 is a front view of the housing.

The housing 20 is formed e.g. of a synthetic resin and has twenty-eight cavities 21 into which the terminal fittings 10 can be inserted from behind. The cavities 21 are arrayed in seven rows in the widthwise direction at four stages along the vertical direction, as shown in FIG. 4. Of course, other numbers and arrangements of cavities can be provided. A guide groove 22 is formed at one side of the bottom surface of each cavity 21 and is dimensioned to receive the stabilizers 13A, 13B of one of the terminal fittings 10. A lattice-shaped partition wall 23 is provided to partition adjacent cavities 21. A front wall 24 is formed at the front end of each cavity 21 and has an opening 25 through which a mating terminal fitting is insertable from front.

A sealing plug mount hole 27 is formed at the rear of the housing 20 and communicates with all of the cavities 21. A sealing plug 28 formed from rubber or other sealing material is fit into the mount hole 28 from behind and along the insertion direction ID. The sealing plug 28 has a specified thickness and is formed to have a substantially rectangular cross section of such a size as to be closely fit in the mount hole 27. Three outer lips 29 are formed on the outer surfaces of the plug 28. The sealing plug 28 has wire insertion holes 31 at positions that correspond to the respective cavities 21 of the housing 20. Three inner lips 31A are formed on the inner surfaces of the respective wire insertion holes 31 for close contact with the outer surfaces of the wires W.

A plug pressing member 33 is mounted behind the sealing plug 28. The plug pressing member 33 is made e.g. of a synthetic resin, and is shaped for closely fitting in a rear part of the plug mount hole 27. The pressing member 33 is substantially lattice-shaped, and has apertures 34 substantially aligned with the respective cavities 21 for receiving the female terminal fittings 10. Guide grooves 35 are formed at sides of the inner bottom surfaces of the respective apertures 34 and align with the guide grooves 22 of the cavities 21. Thus, the stabilizers 13A, 13B of the female terminal fittings 10 are insertable into the guide grooves 35. Arms 36 project forward from the upper and lower sides of the plug pressing member 33 and have lock holes 36A. The lock holes 36A can be engaged on locking projections 26 formed on outer surfaces of the housing 20 for mounting the pressing member 33 behind the rubber plug 28 and thereby preventing the rubber plug 28 from being detached.

Figure 2:
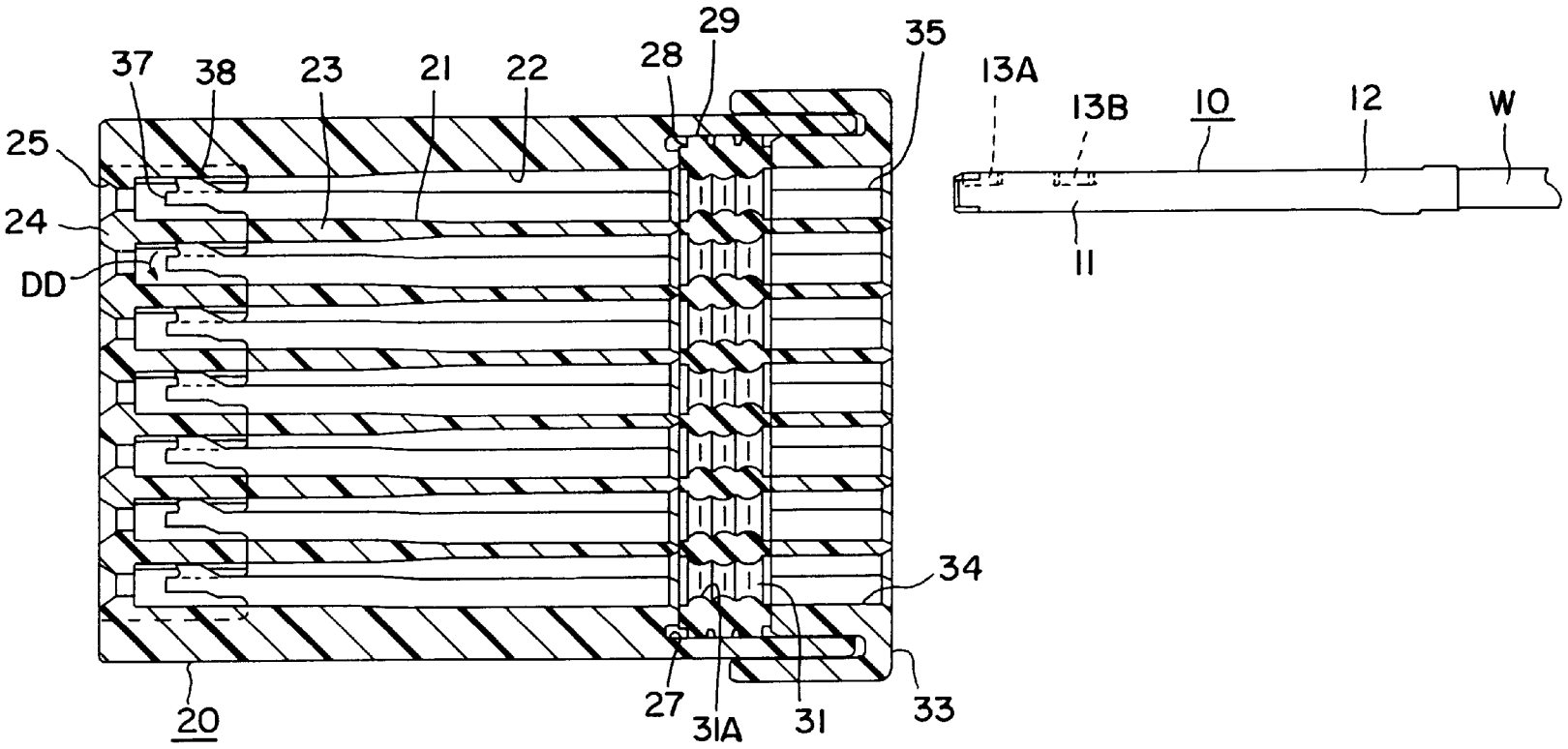
FIG. 2 is a plan view in section of a housing.

The horizontal partition walls 23 are cut away or molded, as shown in FIGS. 1, 2 and 4, to form resiliently deflectable locks 37 that cantilever into the cavities 21 for locking the female terminal fittings 10 in the cavities 21. The locks 37 deform or deflect in direction DD that is substantially parallel with widthwise direction and normal to an imaginary line IL connecting the middle of two vertically adjacent cavities 21.

Figure 5A:
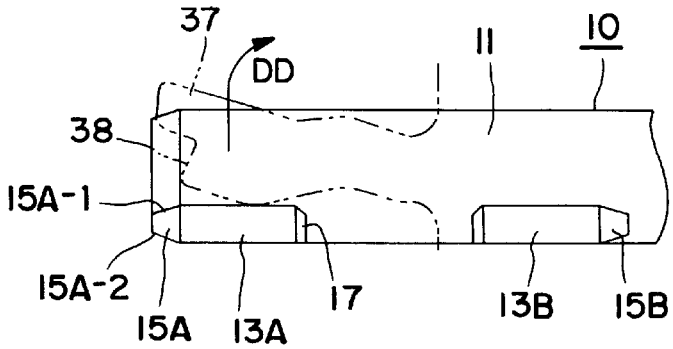
FIG. 5(A) is a bottom view showing a resiliently deformed state of a locking portion and FIG. 5(B) is a bottom view showing an engaged state of the locking portion with a stabilizer.
Figure 5B:
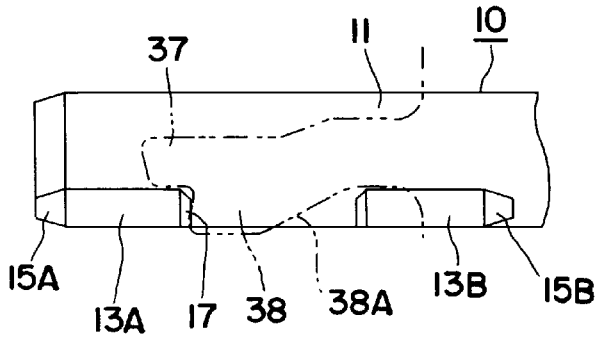

A locking projection 38 projects in the widthwise direction from an upper half of a side surface of each lock 37 that faces the guide groove 22. The locking projection 38 is at a front part of the guide groove 22 and projects into or intersects a passing path of the front stabilizer 13A that has entered the guide groove 22. Thus, the front stabilizer 13A engages the locking projection 38 from behind as the female terminal fitting 10 is inserted into the cavity 21, and deforms the locking portion 37 resiliently, as shown in FIG. 5(A). The rear surface 38A of the locking projection 38 is slanted to guide the lock 37 in the direction DD in response to forces exerted by the front stabilizer 13A. Furthermore, the tapered front end 15A may be slanted in the widthwise or thickness direction TD to form slanted guide portions 15A-1, 15A-2 on the front stabilizer 13A. The slanted guide portions 15A-1, 15A-2 guide the insertion of the front stabilizer 13A into the guide grooves 22, 35 and facilitate deflection of the lock 37 in the deflection direction DD. The front end of the locking projection 38 is behind the front wall 24 of the cavity 21 by about half the length of the stabilizer 13. Thus, the locking projection 38 enters the engaging recess 17 of the female terminal fitting 10 that has been inserted to proper depth, and the front end surface of the locking projection 38 engages the rear end surface of the front stabilizer 13A, as shown in FIG. 5(B).

The connector is assembled by first inserting the sealing plug 28 and the pressing member 33 along the insertion direction ID and into the mount hole 27, as shown in FIG. 1. The female terminal fitting 10 is crimped into connection with the wire W and is inserted in the insertion direction ID into the aperture 34 of the pressing member 33 from behind. An attempt to insert the female terminal fittings 10 upside down will cause the front stabilizer 13A to contact the edge of the aperture 34, thereby preventing an upside-down insertion.

Further insertion of the female terminal fitting 10 causes the main body 11 and the front stabilizer 13A to contact the opening edge of the wire insertion hole 31 of the sealing plug 28. Additional pushing will cause the main body 11 and the front and rear stabilizers 13A, 13B to pass through the wire insertion hole 31 while resiliently deforming the inner peripheral edge of the wire insertion hole 31 outwardly. The tapered front and rear ends 15A, 15B and the slanted guide portions 15A-1, 15A-2 of the stabilizer 13 enable smooth insertion of the terminal fitting 10 without the inner peripheral edge of the wire insertion hole 31 being caught and damaged by corners of the stabilizers 13A and 13B.

Figure 6:
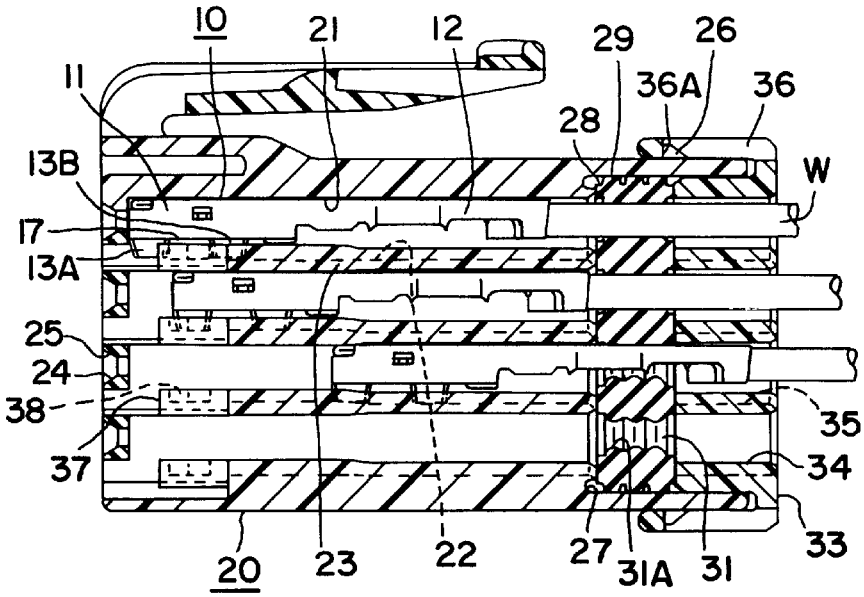
FIG. 6 is a side view in section showing a process of inserting a female terminal fitting into a cavity.
Figure 7:
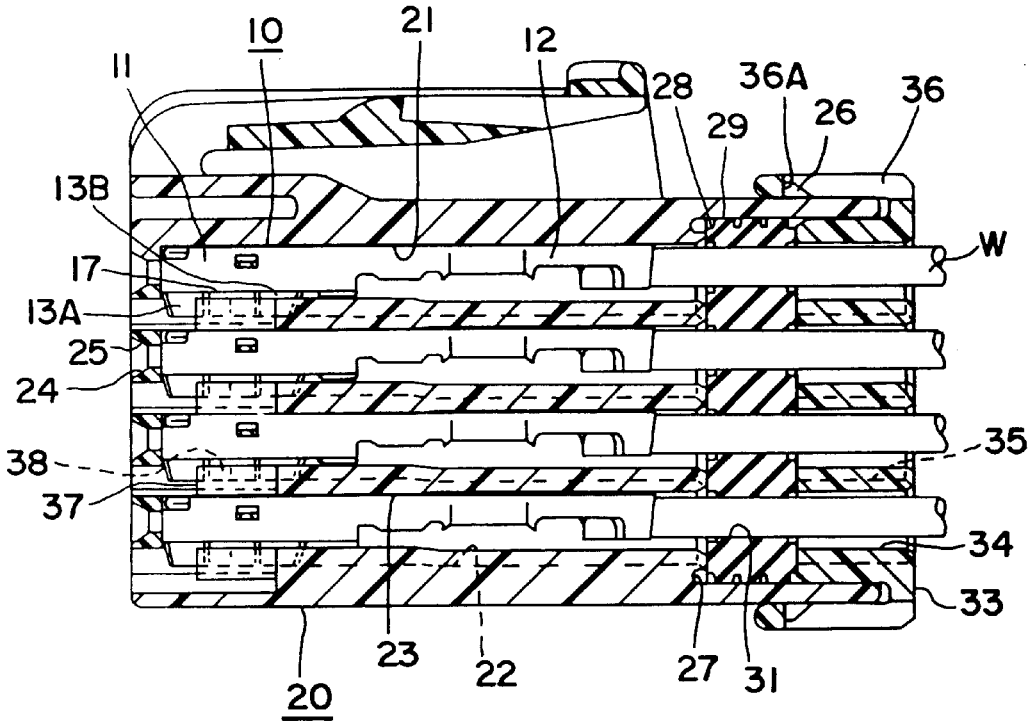
FIG. 7 is a side view in section showing the female connector in which the female terminal fittings are completely assembled.
Figure 16:
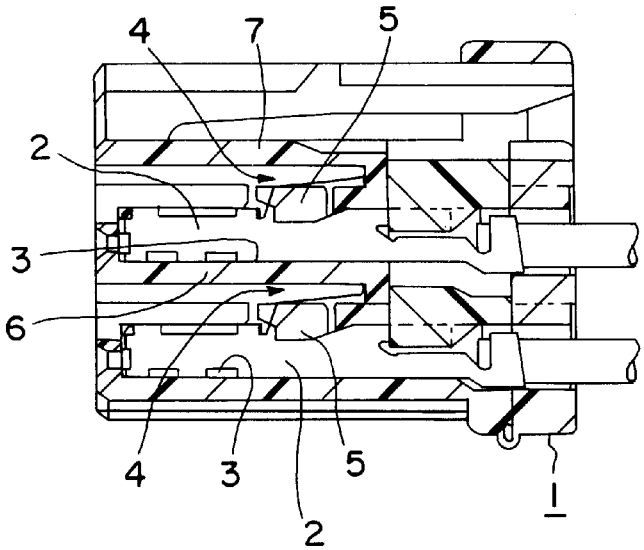
FIG. 16 PRIOR ART
FIG. 16 is a side view in section of a prior art connector.

The female terminal fitting 10 is inserted into the cavity 21 and the front and rear stabilizers 13A, 13B are fitted in the guide groove 22 for smoothly guiding the insertion of the female terminal fitting 10. The front stabilizer 13A eventually passes the guide groove 22 and contacts the rear end surface of the locking projection 38 of the lock 37. Thus, the front stabilizer 13A of the female terminal fitting 10 pushes the locking projection 38 of the lock 37 and resiliently deforms the lock 37 widthwise in the deflection direction DD, as shown in FIGS. 5 and 6. The front stabilizer 13A moves in front of the locking projection 38 of the lock 37 when the terminal fitting 10 reaches the proper insertion depth in the cavity 21, and the lock 37 is restored resiliently. As a result, the locking projection 38 enters the engaging recess 17 and engages with the rear end surface of the front stabilizer 13A, as shown in FIG. 7. In this way, the female terminal fitting 10 is held so as not to come out of the cavity 21.

Partition walls are provided between two adjacent cavities 21 of neighboring stacks or levels of cavities 21 for at least partly partitioning the cavities from each other. The corresponding lock of one cavity 21 is formed in the partition wall between this cavity 21 and the adjacent cavity of the adjacent stack in such a way, that the lock 37 is deflected in the deflection direction DD which is substantially normal to the imaginary line IL passing through the center of the adjacent cavities of the adjacent stacks. Thus, the cavities 21, the locks 37 and the deformation permitting spaces are not arranged along a straight line, and the connector can have a small height. Further, the stabilizer 13A for guiding the insertion of the female terminal fitting 10 also is the portion with which the locking projection 38 of the lock 37 is engaged. Thus, the construction of the female terminal fitting 10 can be simplified.

The engaging recess 17 is between the front and rear stabilizers 13A and 13B and the locking projection 38 of the lock 37 is inserted into the engaging recess 17 for locking. Thus, the stabilizers 13*a,* 13B can be long without enlarging the connector by changing the locking position of the lock 37.

The tapered ends 15A, 15B of the stabilizers 13A, 13B with respect to the inserting direction ID prevent the sealing plug 28 from being damaged when the female terminal fitting 10 is inserted through the plug 28.

A second embodiment of the invention is described with reference to FIGS. 8 to 15. In this embodiment, a female connector has female terminal fittings 110 and a connector housing 20 for accommodating the female terminal fittings 110. In the following description, an inserting direction ID of the female terminal fittings 110 into the housing 20 is referred to as a forward direction and the vertical direction is the orientation shown in FIGS. 8, 10 and 12–15.

Figure 8:
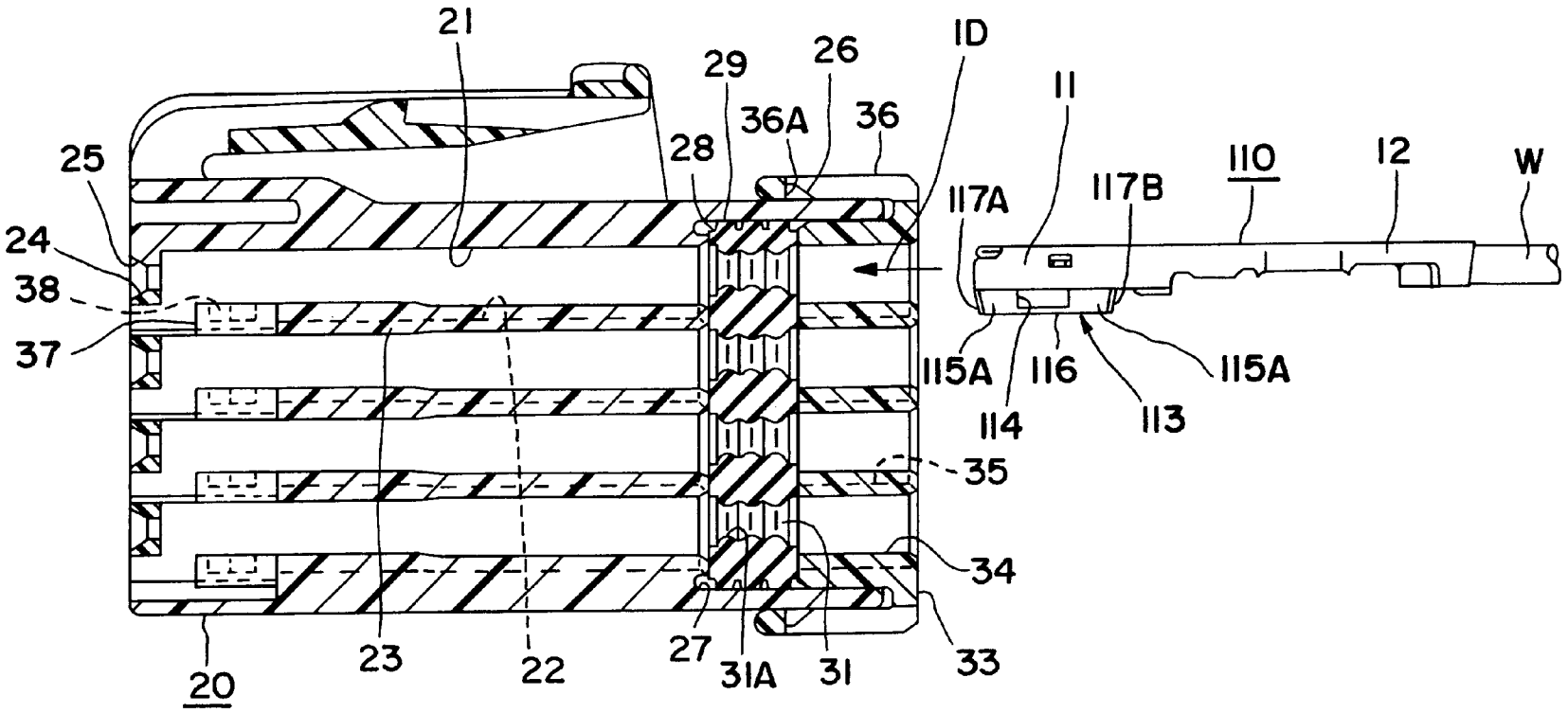
FIG. 8 is an exploded side view in section of a female connector according to a further preferred embodiment of the present invention.
Figure 9:
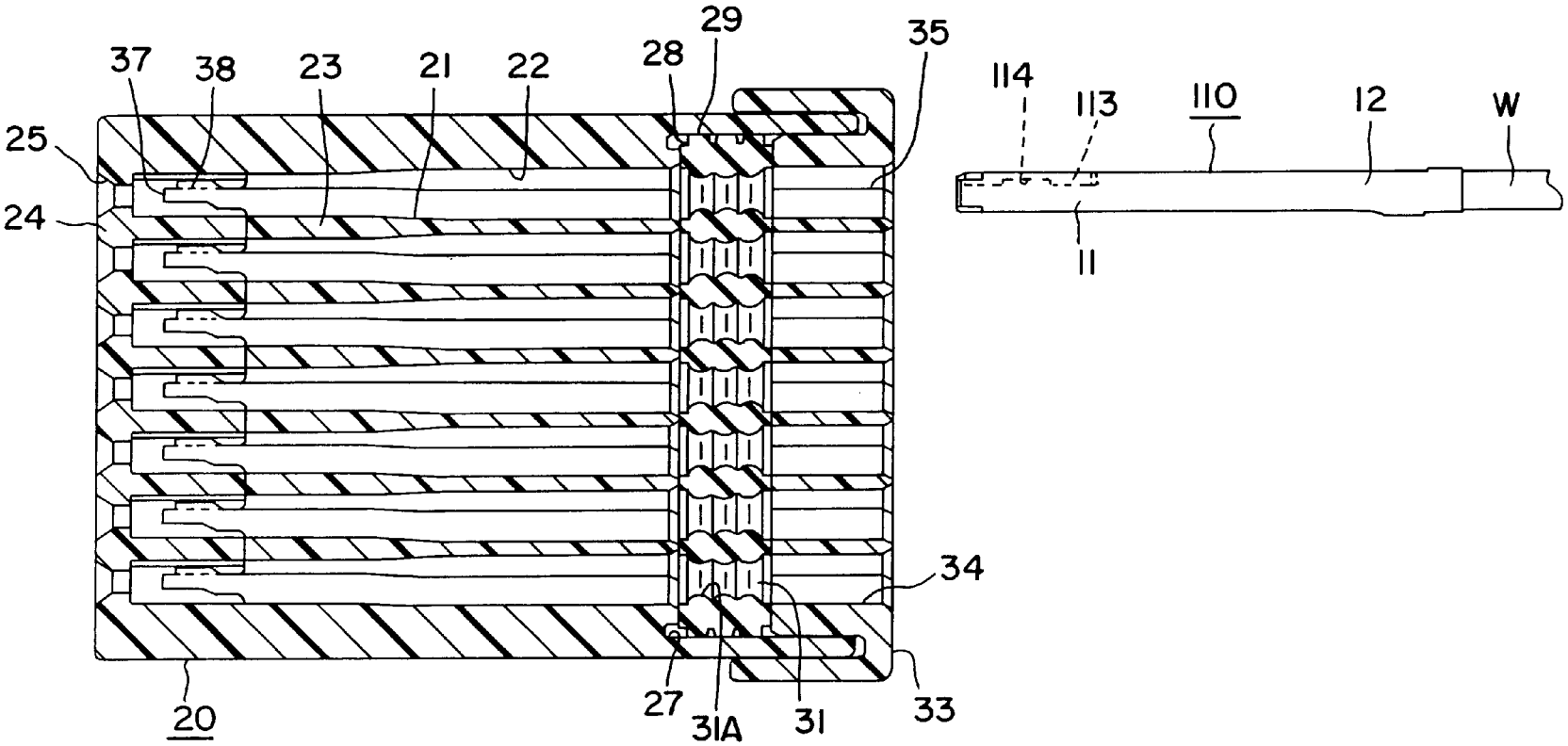
FIG. 9 is a plan view in section of a housing.
Figure 10:
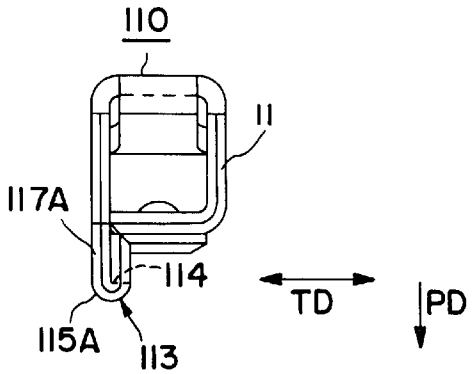
FIG. 10 is a front view of a female terminal fitting.
Figure 11:
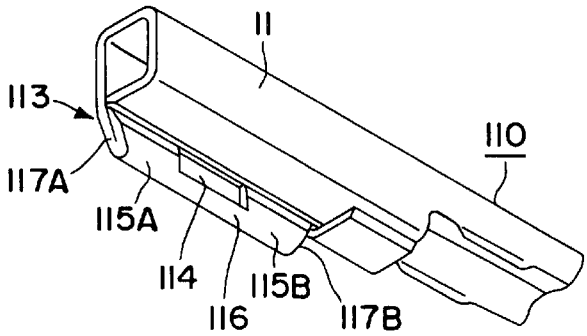
FIG. 11 is a partial enlarged perspective view of the female terminal fitting.
Figure 12:
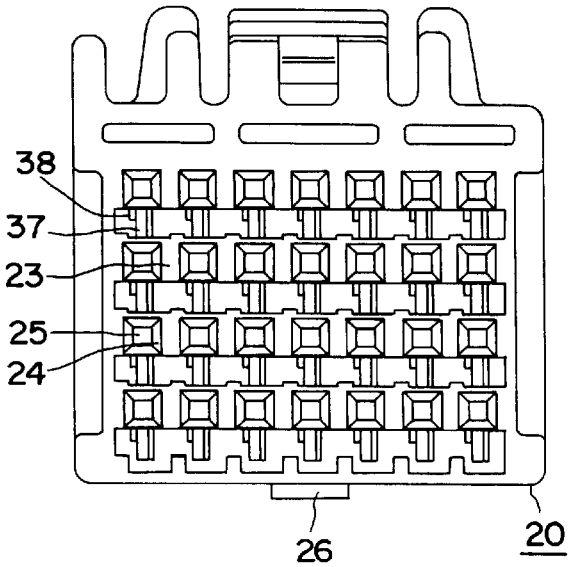
FIG. 12 is a front view of the housing.
Figure 13:
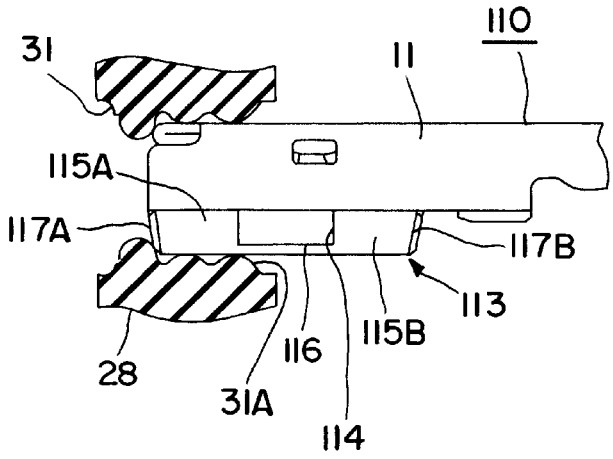
FIG. 13 is a partial enlarged side view in section showing a process of inserting the female terminal fitting into a rubber plug.

Each female terminal fitting 110 is formed by press-working (e.g. stamping, cutting, bending, folding, embossing, milling, etc.) a metallic plate and, as shown in FIG. 8, is provided with a substantially box-shaped main body 11 and a barrel 12 crimped, folded or bent into connection with an end of a wire W. The main body 11 has an open leading end, into which a mating male terminal fitting (not shown) can be inserted for electrical connection. A stabilizer 113 projects down at one side of the bottom surface of the main body 11 as shown in FIGS. 8, 10 and 11. The stabilizer 113 is formed by folding the metallic plate back into a substantially planar structure, and hence has a thickness twice the thickness of the metallic plate. The inner surface of the stabilizer 113 with respect to thickness direction TD is partly cut away at a middle position with respect to forward and backward or longitudinal directions, thereby forming an engaging recess 114. Front and rear portions 115A and 115B are formed on the stabilizer 113 before and behind the engaging recess 114. The stabilizer 113 also is formed with a plug entrance-restricting portion 116 at the bottom end of the engaging recess 114 (i.e. distal end of the stabilizer 113 with respect to its projecting direction). The plug entrance-restricting portion 116 is integrally or unitarily continuous with or bridges the bottom ends of the front and rear portions 115A and 115B. More particularly, the bottom end of plug entrance-restricting portion 116 is a portion of the stabilizer 113 where the metallic plate is folded.

The front portion 115A of the stabilizer 113 has a tapered front end 117A with a base adjacent the front end of the main body 11. The front end 117A then slants rearwardly toward the projecting bottom end of the stabilizer 113. The rear portion 115B of the stabilizer 113 is near the center of the main body 11 with respect to forward and backward or longitudinal directions, and has a rear end 117B that slants forwardly toward narrow the projecting bottom end of the stabilizer 113.

The housing 20 of the second embodiment is similar to the housing described and illustrated with respect to the first embodiment. Accordingly, parts of the housing 20 in the second embodiment that have identical or similar counterparts in the first embodiment merely are identified by the same reference numerals. Additionally the connector of the second embodiment includes a one-piece sealing plug 28 and a sealing plug pressing member 33 that are substantially identical to the sealing plug and the pressing member of the first embodiment.

The connector of the second embodiment is assembled by inserting the sealing plug 28 and the sealing plug pressing member 33 into the mount hole 27, as shown in FIG. 8. The female terminal fittings 110 then are crimped into connection with the wires W and are inserted in the insertion direction ID into the apertures 34 of the pressing member 33 from behind. An attempt to insert the female terminal fittings 110 upside down will cause the front stabilizer 13A to contact the edge of the aperture 34, thereby preventing an upside-down insertion.

Further insertion of the female terminal fitting 110 causes the main body 11 and the stabilizer 113A to contact the opening edge of the wire insertion hole 31 of the sealing plug 28. Additional pushing will cause the main body 11 and the stabilizer 113 to pass through the wire insertion hole 31 while resiliently deforming the inner peripheral edge of the wire insertion hole 31 outwardly. The tapered portion 117A at the front of the stabilizer 113 enables smooth insertion of the terminal fitting 110 without the inner peripheral edge of the wire insertion hole 31 being caught and damaged by corners of the stabilizer 113. Further pushing of the female terminal fitting 110 enables the stabilizer 113 to pass through the wire insertion hole 31 while the respective inner lips 31A of the wire insertion hole 31 are held in sliding contact with the bottom edge of the stabilizer 113. The plug entrance-restricting portion 116 restricts entrance of part of the sealing plug 28, such as the inner lips 31A, into the engaging recess 114. As a result, the female terminal fitting 110 can be inserted smoothly. The bottom end of the plug entrance-restricting portion 116 is formed by folding back the metallic plate. Thus, a fracture surface of the metallic plate is not in contact with the sealing plug 28, and the sealing plug 28 is unlikely to be damaged.

Figure 14:
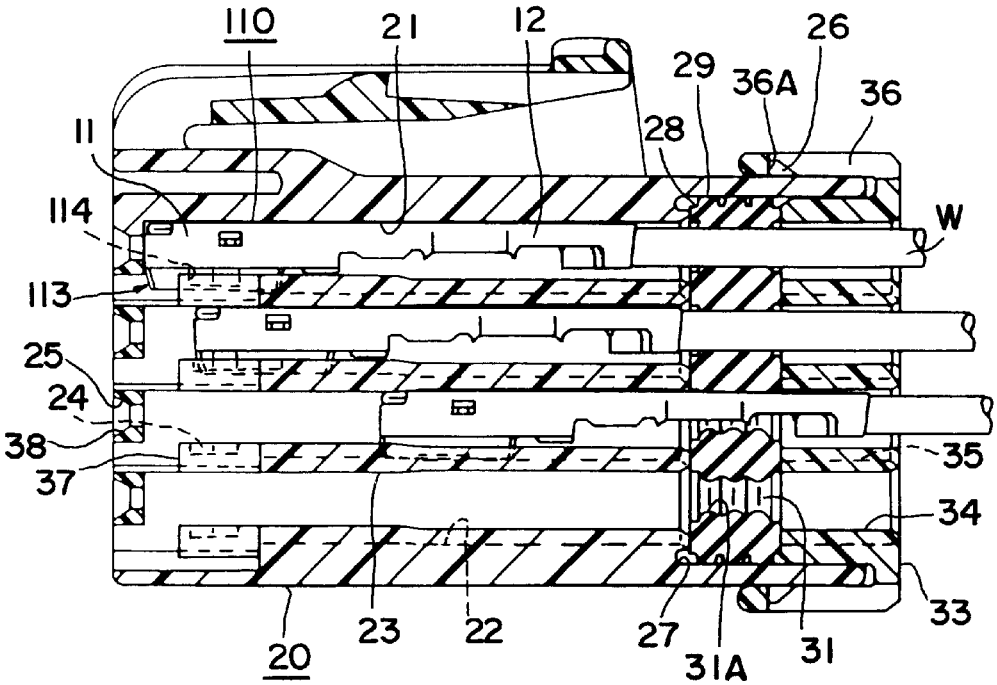
FIG. 14 is a side view in section showing a process of inserting the female terminal fitting into a cavity.
Figure 15:
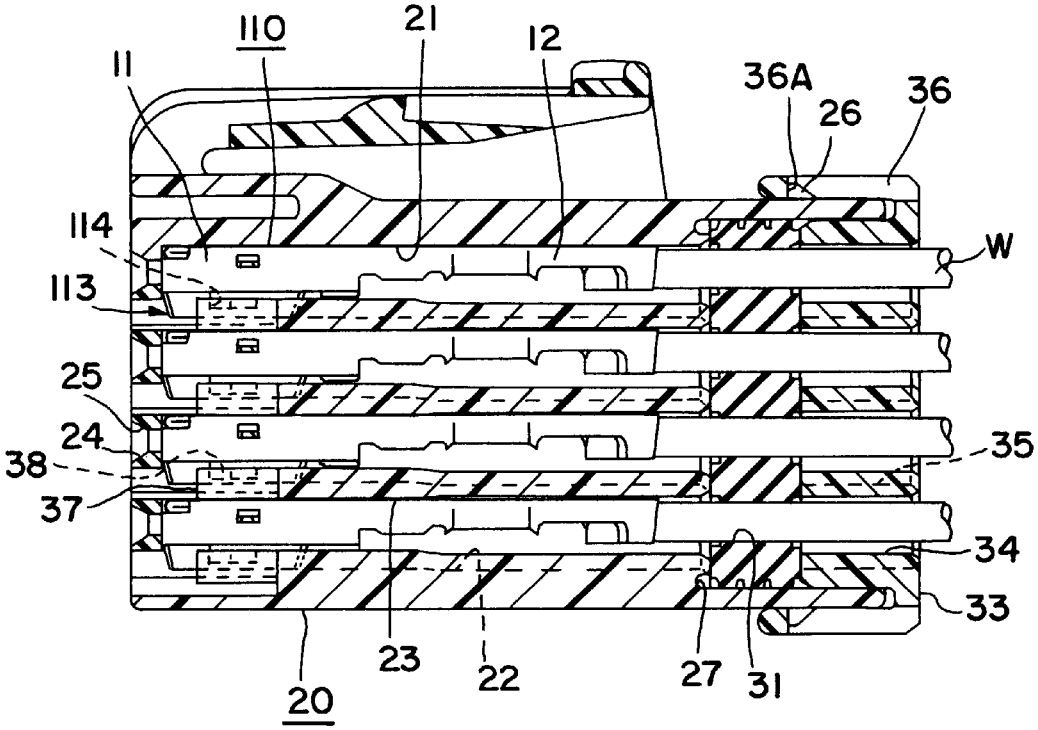
FIG. 15 is a side view in section showing the female connector in which the female terminal fittings are completely assembled.
Figure 17:
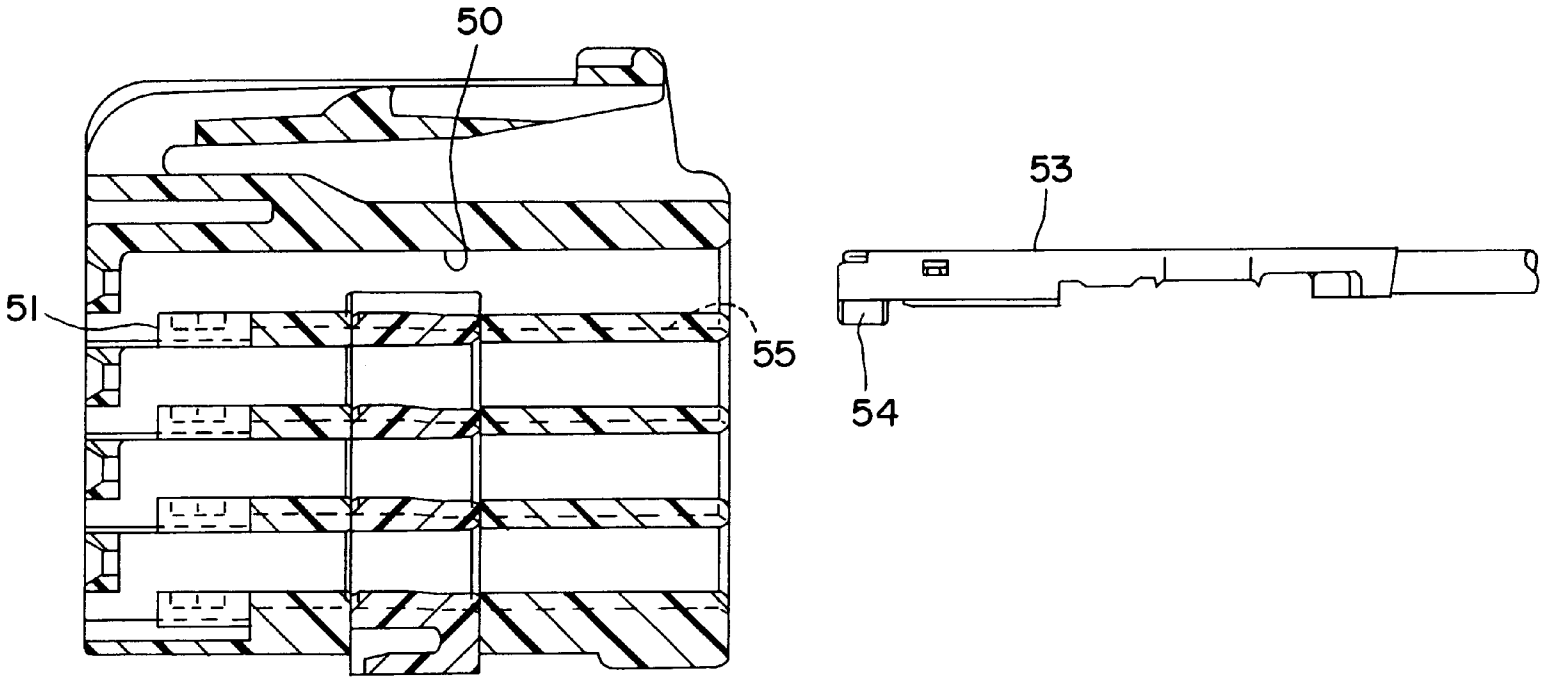
FIG. 17 PRIOR ART
FIG. 17 is an exploded side view in section of another prior art connector.
Figure 18:
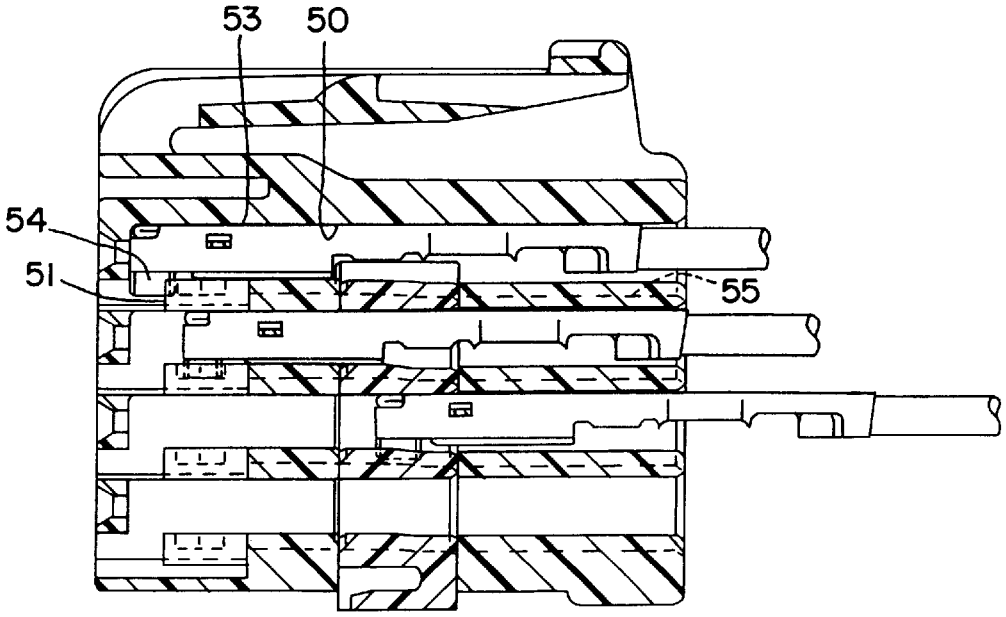
FIG. 18 PRIOR ART
FIG. 18 is a side view in section showing a process of inserting the female terminal fitting into the connector of FIG. 17.

The main body 11 of the female terminal fitting 110 is inserted into the cavity 21 through the rubber plug 28, and the stabilizer 113 is fitted in the guide groove 22 for smoothly guiding insertion of the female terminal fitting 110. The stabilizer 113 eventually passes the guide groove 22 and contacts the rear end surface of the locking projection 38 of the lock 37. Thus, the stabilizer 113 of the terminal fitting 110 pushes the locking projection 38 of the lock 37 and resiliently deforms the lock 37 in the widthwise direction, as shown in FIG. 14. The front portion 115A of the stabilizer 113 moves in front of the locking projection 38 of the lock 37 when the terminal fitting 110 reaches the proper insertion depth in the cavity 21 and the lock 37 is restored resiliently. As a result, the locking projection 38 of the lock 37 enters the engaging recess 114 and is engaged with the rear end surface of the front portion 115A (see FIG. 15). In this way, the female terminal fitting 110 is held in the cavity 21 so as not to come out, and the inner lips 31A of the rubber plug 28 are held in close contact with the outer surface of the wire W while being deformed resiliently to seal the rear part of the cavity 21.

The deforming direction of the locks 37 is normal to the arranging direction of the cavities 21 and the locks 37. Additionally, the cavities 21, the locks 37 and the deformation permitting spaces are not arranged along a straight line, and the connector can have a small height. Further, the stabilizer 113 for guiding the insertion of the female terminal fitting 110 also acts as a portion with which the locking projection 38 of the lock 37 is to be engaged. Thus, the construction of the female terminal fitting 110 can be simplified.

The plug entrance restricting portion 116 is between the front and rear portions 115A, 115B of the stabilizer 113. Thus, no part of the plug 28 enters the engaging recess 114 when the female terminal fitting 110 is inserted through the wire insertion hole 31 of the sealing plug 28. Accordingly, damage to the plug 28 is prevented and good sealing can be achieved.

The front and rear portions 115A, 115B and the rubber plug entrance restricting portion 116 of the stabilizer 113 are formed integrally or unitarily and are continuous with each other. Thus, the construction of the stabilizer 113 can be simpler.

The invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The cavities and the locks are arranged in the height direction of the connector and the locks are deformed resiliently along the widthwise direction of the connector in the foregoing embodiment. However, another construction may be taken provided that the locks engage the stabilizers.

The front and rear stabilizers are provided in the foregoing embodiment. However, a one-piece stabilizer may be adopted. For example, the stabilizer may have a U-shaped cross section and a recessed portion may be an engaging recess to be engaged with the locking projection of the lock.

Although the connector of the foregoing embodiment is a watertight connector with a one-piece sealing plug, the present invention may be applied to a connector having no plug. Further, the plug may not be a one-piece member, but separate plugs may be mounted individually for the respective terminal fittings.

Although the female terminal fittings and the female connector for accommodating them are shown in the foregoing embodiment, the present invention is also applicable to male terminal fittings and a male connector.

Although the engaging recess is formed in the inner surface of the stabilizer with respect to thickness direction in the foregoing embodiment, the engaging recess may, for example, penetrate the stabilizer in thickness direction. In such a case, the rubber plug entrance-restricting portion may bridge the front and rear portions.

What is claimed is:

1. A terminal fitting which is insertable along an insertion direction into a cavity of a connector housing, the connector housing having a resiliently deflectable lock projecting into the cavity for engaging and locking the terminal fitting, the connector housing further having a guide groove extending along an inner wall of the cavity, the terminal fitting comprising:

a stabilizer projecting in a projecting direction arranged at an angle to the inserting direction of the terminal fitting, the stabilizer being dimensioned for insertion into the guide groove for guiding insertion of the terminal fitting into the cavity, and an engaging recess disposed at an intermediate position along the stabilizer for receiving the lock, the stabilizer comprising slanted guide portions tapered in directions transverse to the inserting direction.

2. The terminal fitting of claim 1, wherein the stabilizer has a tapered portion formed at a front end of the stabilizer with respect to the inserting direction.

3. The terminal fitting of claim 1, wherein the stabilizer comprises a front stabilizer portion and a rear stabilizer portion separated from one another along the insertion direction by the engaging recess.

4. The terminal fitting of claim 1, wherein the stabilizer comprises spaced-apart front and rear portions with the engaging recess therebetween, the locking section of the lock being insertable into the engaging recess in a direction substantially normal to the projecting direction of the stabilizer.

5. The terminal fitting of claim 1, wherein the stabilizer and the guide groove are disposed nonsymetrically to prevent upside down insertion of the terminal fitting into the cavity.

6. The terminal fitting of claim 1, wherein the connector comprises a sealing plug formed with at least one through hole, the terminal fitting comprising a sealing plug entrance restricting portion for restricting entrance of part of the sealing plug into the engaging recess when the terminal fitting is inserted through the through hole in the sealing plug.

7. The terminal fitting of claim 6, wherein the front portion, the sealing plug entrance restricting portion and the rear portion of the stabilizer are formed unitarily with each other.

8. A terminal fitting which is insertable along an insertion direction into a cavity of a connector housing, the connector housing having a resiliently deflectable lock projecting into the cavity for engaging and locking the terminal fitting, the connector housing further having a guide groove extending along an inner wall of the cavity, the terminal fitting comprising:

a stabilizer projecting in a projecting direction arranged at an angle to the inserting direction of the terminal fitting, the stabilizer being dimensioned for insertion into the guide groove for guiding insertion of the terminal fitting into the cavity, and an engaging recess disposed at an intermediate position along the stabilizer for receiving the lock, wherein the engaging recess does not extend over the full thickness of the stabilizer in a thickness direction thereof.

9. A connector, comprising:

a housing having opposite front and rear ends, at least one cavity formed in the housing and extending along an insertion direction between the front and rear ends, a groove formed in an internal wall of the housing and extending parallel to the insertion direction, a resiliently deflectable lock formed in the housing and cantilevered into the cavity, the housing further having a sealing plug mounting recess;

a terminal fitting slidably inserted into the cavity, the terminal fitting being formed with an elongate stabilizer extending parallel to the insertion direction and slidably inserted into the groove, the stabilizer being formed with an engaging recess, the lock being disposed in the engaging recess for locking the terminal fitting in the cavity; and at least one sealing plug being inserted into the sealing plug mounting recess to waterproof the connector, the sealing plug having at least one through hole for receiving the terminal fitting, and wherein the stabilizer comprises a sealing plug entrance restricting portion for restricting entrance of part of the sealing plug into the engaging recess when the terminal fitting is inserted through the through hole formed in the sealing plug.

10. The connector of claim 9, wherein the at least one cavity comprises a plurality of cavities, a partition wall being provided between two adjacent cavities, the lock being formed in the partition wall for deflection in a deflection direction substantially normal to an imaginary line passing through centers of the adjacent cavities.

11. The connector of claim 9, wherein the stabilizer has a tapered portion formed at a front end of the stabilizer with respect to the inserting direction.

12. The connector of claim 9, wherein the stabilizer comprises slanted guide portions tapered in directions transverse to the insertion direction.

13. The connector of claim 9, wherein the stabilizer comprises a front stabilizer portion and a rear stabilizer portion separated from one another along the insertion direction by the engaging recess.

14. A connector, comprising:

a housing having opposite front and rear ends, at least one cavity formed in the housing and extending along an insertion direction between the front and rear ends, a groove formed in an internal wall of the housing and extending parallel to the insertion direction, a resiliently deflectable lock formed in the housing and cantilevered into the cavity;

a terminal fitting slidably inserted into the cavity, the terminal fitting being formed with an elongate stabilizer extending parallel to the insertion direction and slidably inserted into the groove, the stabilizer being formed with an engaging recess, the lock being disposed in the engaging recess for locking the terminal fitting in the wherein the stabilizer comprises spaced-apart front and rear portions with the engaging recess therebetween, the locking section of the lock being insertable into the engaging recess in a direction substantially normal to the projecting direction of the stabilizer.

15. A connector, comprising:

a housing having opposite front and rear ends, at least one cavity formed in the housing and extending along an insertion direction between the front and rear ends, a groove formed in an internal wall of the housing and extending parallel to the insertion direction, a resiliently deflectable lock formed in the housing and cantilevered into the cavity, the lock being deflectable about an axis normal to the insertion direction and normal to the internal wall with the groove, the lock having a projecting portion disposed to intersect a plane passing through the groove and parallel to the axis; and a terminal fitting slidably inserted into the cavity, the terminal fitting being formed with an elongate stabilizer extending parallel to the insertion direction and slidably inserted into the groove, the stabilizer being formed with an engaging recess, the lock being disposed in the engaging recess for locking the terminal fitting in the cavity.

* * * * *